United States Patent [19]

Awalt, Jr.

[11] Patent Number: 4,479,452

[45] Date of Patent: Oct. 30, 1984

[54] ANCHOR HANDLING AND STORAGE DEVICE

[75] Inventor: Thomas Y. Awalt, Jr., Pensacola, Fla.

[73] Assignee: Deep Seven Co., Pensacola, Fla.

[21] Appl. No.: 420,284

[22] Filed: Sep. 20, 1982

Related U.S. Application Data

[63] Continuation-in-part of Ser. No. 216,063, Dec. 12, 1980, abandoned.

[51] Int. Cl.[3] ..... B63B 21/22

[52] U.S. Cl. ..... 114/210

[58] Field of Search ..... 114/210, 293, 310

[56] References Cited

U.S. PATENT DOCUMENTS

| | | | |
|---|---|---|---|
| 2,734,475 | 2/1956 | Fyock | 114/210 |
| 2,844,119 | 7/1958 | Dugan | 114/210 |
| 2,899,924 | 8/1959 | Good | 114/210 |
| 3,635,187 | 1/1972 | Webb | 114/210 |
| 3,785,323 | 1/1974 | Lantz | 114/210 |
| 3,865,065 | 2/1975 | Dennis et al. | 114/210 |
| 3,974,793 | 8/1976 | Aring | 114/210 |

*Primary Examiner*—Sherman D. Basinger

*Attorney, Agent, or Firm*—Thomas Y. Awalt, Jr.

[57] ABSTRACT

A handling and storage device for a swivel-fluke-type marine anchor comprises an interrelated shank-receiving boom and fluke channeling member both being rotatable with parallel axes of rotation. When the shank of the anchor is held in position by the shank-receiving boom, the fluke channeling member receives and folds the anchor into an essentially planar position. In a preferred embodiment suitable for vertical or receding sides and transoms the axes are separate but parallel, and the axis of the boom is on a boom support frame which is also rotatable and which holds the boom away from the side or transom when in the receiving position.

9 Claims, 5 Drawing Figures

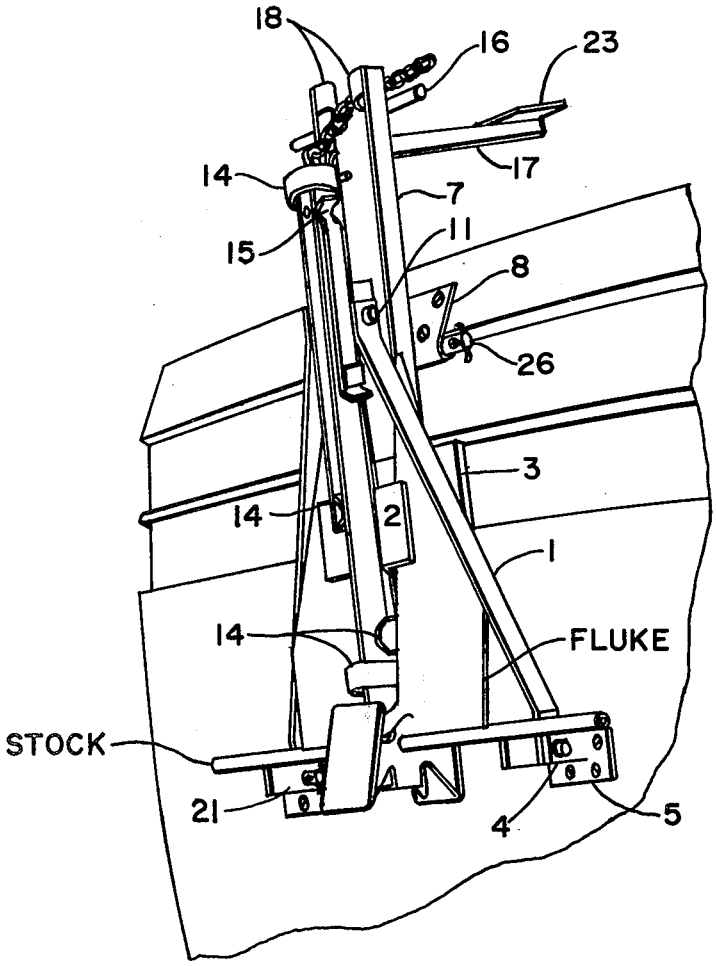
FIG. 4
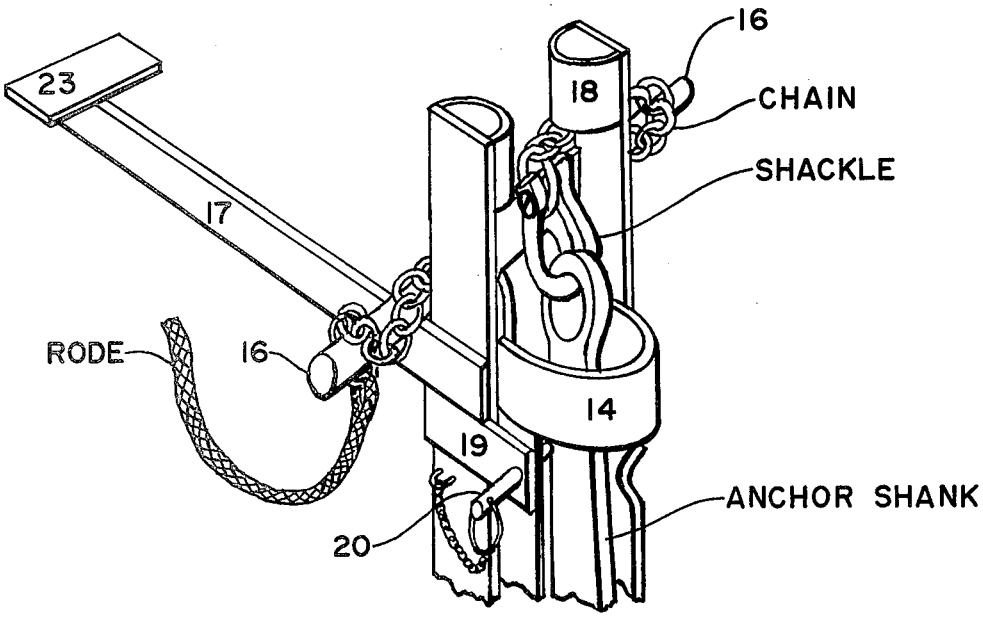

ANCHOR HANDLING AND STORAGE DEVICE

This application is a continuation-in-part of my copending U.S. patent application Ser. No. 216,063 filed Dec. 12, 1980 and now abandoned.

FIELD OF THE INVENTION

The invention relates to marine anchor handling and stowage devices, particularly those for swivel-fluke-type anchors.

BACKGROUND OF THE INVENTION

The light weight swivel-fluke-type anchor, most noted and successful of which was developed and patented by the Danforth Company, is accepted among modern day seamen as the most reliable general purpose anchor presently known to the art. While only occasionally difficult to set due in part to the light weight for which it is named, its holding power and dependability for most purposes far exceeds that of other designs.

Unfortunately for the boating, yachting and shipping industries, the so-called "light weight" is not the most convenient of anchors to handle and stow. It has been replaced to a large extent, particularly on sail boats, by the plow (plough or "CQR") because the plow is more easily stowed on a pulpit or bow sprit and has fewer offensive projections such as the stock of the light weight which might snag sails and the like. Even on power boats when the light weight is stowed, projecting over the bow as taught in U.S. Pat. Nos. 2,899,925; 3,865,065 or 3,635,187 there are stowage problems including forward and lateral projections which can and do complicate mooring, maneuvering, etc. When the light weight is stowed on deck, as has been traditional, it presents serious handling problems. A 35–45 pound anchor is difficult to lift at arms length over the boat' gunwhale and under its life lines. The anchor also is a troublesome cause of mud or dirt on the deck and it monopolizes precious space. [Handling devices such as taught in U.S. Pat. No. 3,974,793 may solve handling problems but not the dirt and space problems.]

If it were practical to provide a handling and stowage device which shielded nuisance projections, which did not monopolize essential space, which did not introduce mud or dirt onto the deck of vessels, and which was easy and safe to handle, such a device would constitute a significant advance in the art and achieve three objects of this invention.

A fourth and most important object of this invention is to provide a stowage and handling device for a readily usable anchor which can be placed on the stern side or transom of a vessel. Such stowage has many uses including emergency use to prevent stranding, dropping and setting a first anchor of a "Bahama moor" (otherwise known as the Ogg system) in windy or crowded anchorages, mooring the vessel with the bow to a beach, and fore and aft anchoring.

SUMMARY OF THE INVENTION

As stated above, the invention is a handling and stowage device for a swivel fluke-type anchor of a type having a shank and generally planar flukes. The device comprises a rotatable means, preferably a boom, having a first axis of rotation for receiving, holding and releasing the shank of the anchor and a rotatable anchor fluke-receiving, folding, holding and releasing channeling member, preferably comprising a fluke tip diversion (back) plate with channeling guides, having a second axis of rotation substantially parallel to the first axis of rotation and in a position such that when the anchor being pulled up by its shank is held in proper juxtaposition with the channeling member by the shank of the anchor on the boom, the channeling member can receive and secure the fluke portion of the anchor and fold the flukes in towards the shank, resulting in the anchor being secured in a substantially planar situation. In a preferred embodiment, the boom is on a frame which itself is rotatable, and which in the lowered position holds the anchor clear of the sides of the vessel. This embodiment is most suited for a vertical or receding side or transom mount. As used herein, the term "side" is used to include the transom.

In the detailed description reference will be made to the drawing in which:

FIGS. 1–4 show in order four stages of recovery of an anchor and, in reverse order, four stages of release of an anchor.

FIG. 5 shows in detail the upper portion of the apparatus depicted in FIGS. 1–4.

FIGS. 1–5 are perspective views of a preferred embodiment of this invention.

DETAILED DESCRIPTION OF THE INVENTION

Figure 1:
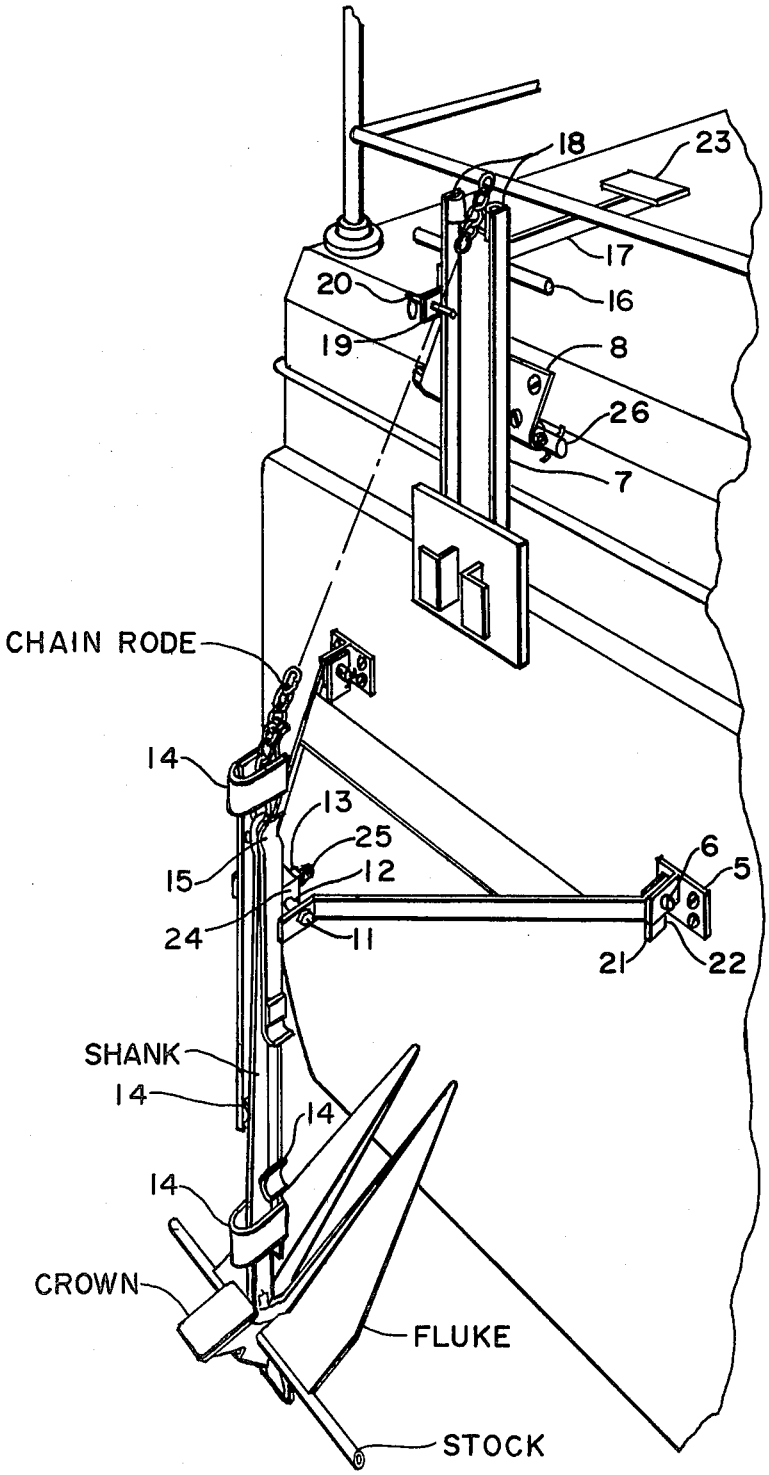

Referring now to FIGS. 1–5, boom support frame 1 is connected by pins 6 to, and turns in flange ears 4 on flange 5 which is bolted to the side or transom of the vessel. At the apex of frame 1 is a fairlead and anchor shank receiving boom 9 which carries the shank of the anchor and is universally mounted on the apex of the frame through bolt 11 with nut 10, sleeve 12, pivot plate 13 and another sleeve 24 and bolt 25 under the boom. Boom 9 has fixed guides 14 and spring loaded guide 15. Guides 14 may be closed as shown or open for release of the rode. In the stowed position (FIG. 4), the flukes of anchor are held in a fluke receiving channel (channeling member) defined by fluke guides 2 and back plate 3. Back plate 3 is attached to fairlead arm 7 which is separately hinge mounted to the side or transom of the vessel on hinge 8 with hinge pin 26. Fairlead arm 7 has at the top (above the hinge) bit arm 16 (optional), control force lever arm 17 with pedal-handle 23, fairlead projections 18 (optional) and locking arm 19 (optional) for locking pin 20.

Frame 1 carries optional support projections 21 for the anchor stock with a lower position stop surface 22 explained below. Support projections 21 may be notched to receive the stock of the anchor.

To prepare for release, the rode (chain and/or line) is removed from bit arm 16 and, if locked, pin 20 is removed from locking arm 19. Control force lever arm 17 is depressed by foot pressure on pedal-handle 23 (FIG. 2) causing the fluke receiving channel to project outwardly which in turn directs the flukes away from the shank, at the same time moving the lower portion of the anchor away from the vessel and lower portion of frame so that the stock of the anchor clears support projections 21. As the rode is slackened, frame 1 rotates from the position shown in FIG. 2 to the position shown in FIG. 1. Notice that the shank of the anchor does not move along boom 9 until the boom on frame 2 is in the lower position shown at FIG. 1 (in which position the frame is held when surface 22 comes to rest against flange 5). When the frame assumes this lower position and the rode is further released the anchor will proceed to the bottom.

On recovery of the anchor, the anchor is brought up to a position as shown at FIG. 1. When the shank of the anchor is on the boom as shown at FIG. 1 progress of the anchor is delayed by spring loaded guide 15 while the frame raises toward the vertical position.

Figure 2:
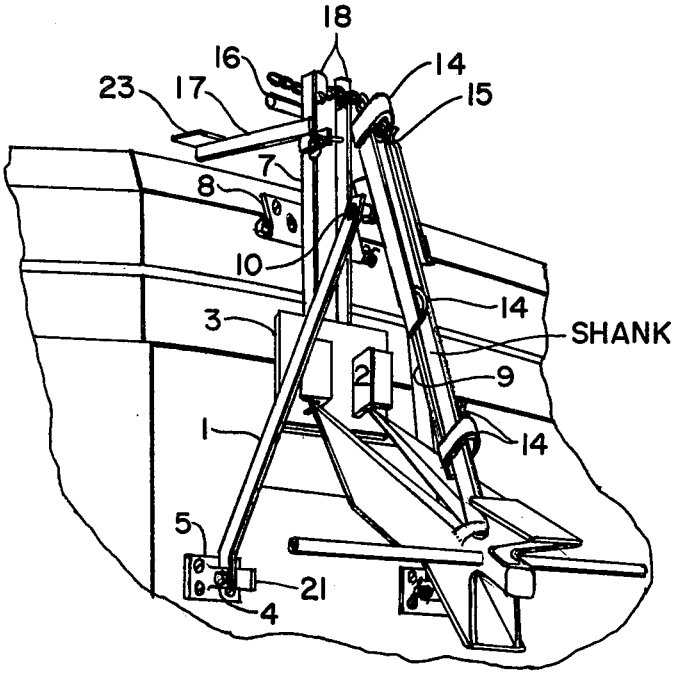
Figure 3:
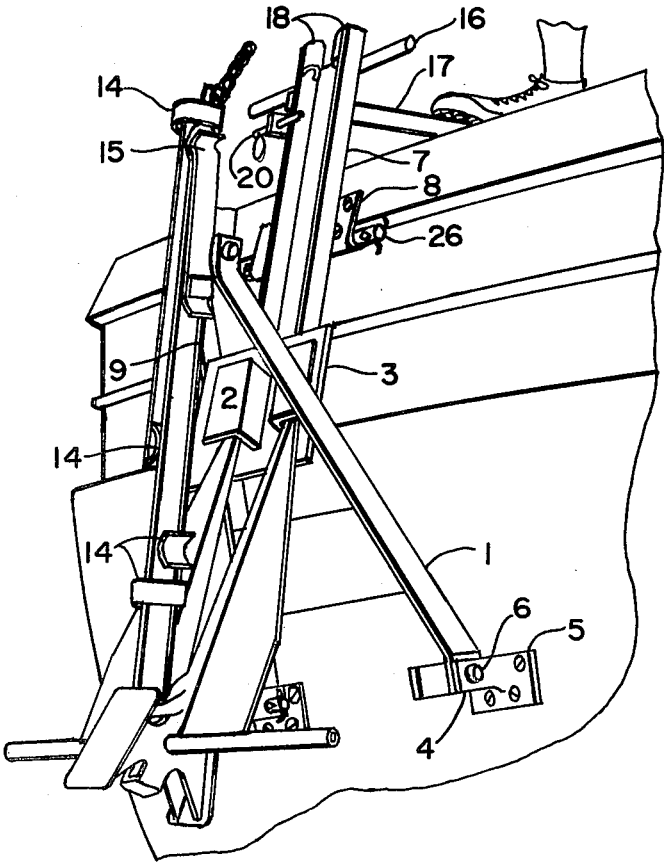

At the position shown at FIG. 2 the tips of the fluke are brought to rest against back plate 3. At this point, pedal-handle 23 is depressed as shown at FIG. 3 and the anchor rode is pulled in further. These actions bring the flukes within the fluke receiving channels. To finally seat and lock the anchor within the frame the operator reaches down and pulls up on pedal-handle 23 causing the fluke receiving channel to direct the flukes toward a position parallel-planar with the shank and move the lower portion of the anchor in toward the side of the vessel so that the stock of the anchor seats itself on projections 21 as shown in FIG. 4.

The boom can then be locked for sea by inserting pin 20 into locking arm 19 and boom 9 as shown at FIG. 5.

The boom shown in the preferred embodiment is universally mounted to permit more flexibility in retrieving the anchor along the direction of the rode. However it is not essential to the operation of this device that the boom be universally mounted. Any rotatable mounting with the described axis of rotation will suffice.

In accordance with this invention the shank of the anchor is received along the boom while in a generally vertical position but preferably with the base (fluke end) of the shank inclined slightly (0°–45°) away from the side of the vessel. The tips of the flukes are received in the fluke receiving channels from the natural position of the flukes; and from this position responsive to a control force the channels direct the flukes to a position whereby the flukes are generally coplanar with the shank. Direction of the flukes toward the coplanar position involves pressure against the tips of the flukes toward the shank and away from the side of the vessel, and against a more proximal portion of the flukes away from the plane of the shank and toward the side of the vessel. The anchor is then stowed with the flukes and the shank generally (±20°) in the same plane, generally coplanar (±30°) with the sides of the vessel and generally (±45°) in a vertical plane.

In releasing the anchor it is ordinarily necessary for the channeling member to direct the flukes in the opposite direction; however this effort may be accomplished by a gentle force nudging boom 9 away from the plane of the side of the vessel, this being assisted by the force of gravity to cause frame 2 to move toward a horizontal position and free the flukes from the channeling member.

The control force may be applied manually by the lever-handle as shown in the preferred embodiment or by any number of convenient manual, hydraulic or mechanical methods well known among mechanical engineers.

While the drawing shows a device designed primarily for the anchor rode to be pulled or released by hand, it is also suitable for operation with a winch or windlass and can be made even more suitable with minor boom configuration changes or with the use of an appropriate deck mounted fairlead device.

I claim:

1. A handling and stowage device for a swivel fluke-type anchor having a shank and generally planar flukes for folding and storing the anchor generally vertically and parallel-planar to the side of a vessel having generally vertical or upwardly receding sides comprising in combination (a) an anchor shank receiving boom having a first axis of rotation permitting the boom to assume an inclined position and a generally vertical position for receiving, holding and releasing the shank of the anchor;

(b) means for universally mounting the boom;

(c) rotatable boom support means for the boom mounting means comprising an elongated open frame;

(d) attachment means whereby the rotatable boom support means can be secured on the side of the vessel in such a manner that when the frame is in at least one position an unfolded anchor with its shank in the shank receiving boom will clear the side of the vessel;

(e) a rotatable anchor fluke-receiving, folding, holding and releasing channeling member having a second axis of rotation substantially parallel to the first axis of rotation permitting movement of the channeling member in an arc generally from the side of the vessel to a position whereby while the shank of the anchor is along the boom in an inclined position the flukes of the anchor being held in juxtaposition with (e) by (a) can be received from their natural position with tips extending away from the shank into the channeling member, folded toward a position generally coplanar with the shank by first control forces exerted through said channeling member against a distal portion of said flukes in a direction generally towards the shank, and while applying the forces by moving around said second axis of rotation, drawing both shank and flukes generally parallel planar and in close proximity to the side of the vessel, said flukes being held in said coplanar position and released from said coplanar position by application of second control forces opposite to said first control forces;

(f) mounting means for the rotatable channeling member; and (g) control force receiving and transfer means for the channeling member whereby external rotational force may be applied to the channeling member and transmitted through the channeling member to the anchor flukes.

2. The handling and stowage device of claim 1 wherein the anchor fluke receiving, folding, holding and releasing channeling member comprises a fluke tip diversion plate and channeling guides.

3. The device of claim 2 wherein the channeling guides are for interior longitudinal edges of the flukes.

4. The anchor handling and stowage device of claim 1 wherein the anchor shank-receiving boom has fixed guides and at least one spring loaded guide.

5. The device of claim 1 wherein the boom support means is a generally "A" shaped frame with said boom mounting means at the apex of the frame.

6. The device of claim 5 further including support means on a proximal portion of the frame for supporting an anchor stock while in a generally vertical plane.

7. The device of claim 1 further including fairlead means on said boom.

8. The device of claim 1 further including rode securing means independent of the boom.

9. The device of claim 1 further including locking means whereby the anchor shank may be locked in the boom.

* * * * *